US009032653B2

(12) United States Patent
English

(10) Patent No.: US 9,032,653 B2
(45) Date of Patent: May 19, 2015

(54) DISPLAY ADS FOR DOOR HANDLES PROVIDING MULTISENSORY STIMULI

(75) Inventor: Larry English, Deer Park, IL (US)

(73) Assignee: Wild August LLC, Deer Park, IL (US)

( * ) Notice: Subject to any disclaimer, the term of this patent is extended or adjusted under 35 U.S.C. 154(b) by 137 days.

(21) Appl. No.: 13/570,011

(22) Filed: Aug. 8, 2012

(65) Prior Publication Data

US 2014/0001982 A1 Jan. 2, 2014

Related U.S. Application Data

(63) Continuation-in-part of application No. 13/540,534, filed on Jul. 2, 2012.

(60) Provisional application No. 61/502,432, filed on Jun. 29, 2011.

(51) Int. Cl.
*G09F 23/00* (2006.01)
*G09F 7/18* (2006.01)

(52) U.S. Cl.
CPC ..... *G09F 23/0058* (2013.01); *G09F 7/18* (2013.01)

(58) Field of Classification Search
CPC ..... F24F 2011/0075; G06Q 10/1053; G06Q 30/0242; E05F 15/2023; E05F 2015/0043
USPC ..... 40/599, 611.06; 248/230.1, 311.2
See application file for complete search history.

(56) References Cited

U.S. PATENT DOCUMENTS

| | | | |
|---|---|---|---|
| 2,383,881 | A | 8/1945 | Murphy |
| 2,795,527 | A | 6/1957 | Heyer |
| 3,894,707 | A | 7/1975 | Heard |
| 4,300,299 | A | 11/1981 | Batky et al. |
| 4,344,244 | A | 8/1982 | Tyke |
| 4,408,922 | A | 10/1983 | D'Alessio |
| 4,548,377 | A | 10/1985 | Huel |
| 4,955,153 | A | 9/1990 | Albrecht et al. |
| 5,417,458 | A | 5/1995 | Best |
| 5,428,913 | A | 7/1995 | Hillstrom |
| 5,560,131 | A | 10/1996 | Gibson |
| 5,590,504 | A | 1/1997 | Heard et al. |
| 6,092,841 | A | 7/2000 | Best |
| 6,119,385 | A | 9/2000 | Olivier |
| 6,186,454 | B1 | 2/2001 | Olsen |
| 6,241,287 | B1 | 6/2001 | Best |
| 6,364,099 | B2 | 4/2002 | Emoff |

(Continued)

FOREIGN PATENT DOCUMENTS

| | | |
|---|---|---|
| GB | 176590 | 3/1992 |

OTHER PUBLICATIONS

Patent Cooperation Treaty, International Search Report (PCT Article 18 and Rules 43 and 44), International application No. PCT/US 13/47048, Feb. 21, 2014.

*Primary Examiner* — Tracie Y Green

(74) *Attorney, Agent, or Firm* — Flachsbart & Greenspoon, LLC

(57) ABSTRACT

A display ad system for door handles may include electronics that provide multisensory stimuli. In one embodiment, an end cap includes light and sound triggered by a motion detector. In another embodiment, an end cap includes fan-directed aromas triggered by a motion detector. In a third embodiment, a flexible grid of LED lights backlights the display ad in any time sequence desired, and may be motion-triggered as well. A door handle embodiment may also provide a note board surface as an alternative to showing display ads.

5 Claims, 19 Drawing Sheets

(56) References Cited

U.S. PATENT DOCUMENTS

| | | | | |
|---|---|---|---|---|
| 6,411,215 | B1 * | 6/2002 | Shnier | 340/686.1 |
| 6,481,811 | B1 | 11/2002 | Marsh | |
| 6,525,659 | B2 * | 2/2003 | Jaffe et al. | 340/545.6 |
| 6,550,170 | B1 | 4/2003 | Cooper et al. | |
| 6,700,486 | B1 * | 3/2004 | Banki | 340/541 |
| 6,948,272 | B1 | 9/2005 | Olivier et al. | |
| 7,065,910 | B2 * | 6/2006 | Woodruff | 40/544 |
| 7,383,654 | B2 | 6/2008 | Olivier et al. | |
| 7,588,224 | B2 | 9/2009 | Bates et al. | |
| 7,762,022 | B2 * | 7/2010 | Stadler et al. | 49/506 |
| 7,784,208 | B2 | 8/2010 | Thompson | |
| 7,946,547 | B2 | 5/2011 | Bernstorf et al. | |
| 8,336,837 | B2 | 12/2012 | Gephart et al. | |
| 8,376,298 | B2 | 2/2013 | McPheeters | |
| 8,528,939 | B2 | 9/2013 | Turner | |
| 8,819,971 | B2 * | 9/2014 | English | 40/661.12 |
| 2001/0013186 | A1 * | 8/2001 | Malitas | 40/599 |
| 2007/0253208 | A1 | 11/2007 | Howard et al. | |
| 2008/0235911 | A1 | 10/2008 | Olivier | |
| 2010/0154265 | A1 | 6/2010 | Poulokefalos | |
| 2010/0236111 | A1 | 9/2010 | Cheetwood | |
| 2014/0053440 | A1 * | 2/2014 | English | 40/599 |

* cited by examiner

DISPLAY ADS FOR DOOR HANDLES PROVIDING MULTISENSORY STIMULI

This application is a continuation-in-part of U.S. patent application Ser. No. 13/540,534, filed Jul. 2, 2012, which claims the benefit of U.S. Provisional Application No. 61/502,432, filed Jun. 29, 2011.

TECHNICAL FIELD OF THE INVENTION

The present invention relates generally to display advertising surfaces, and more specifically to assemblies that are added to or combined with pre-existing door handles. It also relates to electronic devices to make such assemblies more effective. It also relates to use of the relevant surfaces for erasable notes and memos, as an alternative to display advertising.

BACKGROUND OF THE INVENTION

The placing of display advertisements near consumer shelf space is generally known. Of late, retailers and advertisers have placed display ads on surfaces associated with the door handles of refrigeration coolers. For example, U.S. Pat. No. 7,383,654 describes an assembly that replaces entirely a cooler door handle, such as on the cooler aisle of a grocery or convenience store. On the assembly, there is a surface within a cavity that allows the interchanging of graphic displays, including advertisements. The assembly is mounted directly to the door itself after the pre-existing handle is removed.

There are several advantages to these kinds of assemblies. They allow ads to receive consumer attention at or near the moment of purchase. They also allow for quick and easy advertisement changes.

What is needed is an assembly that does not require replacement of a door handle. What is also needed is a capacity to mate a display advertising surface with the wide variety of legacy door handles that currently exist at retail point of sale locations. What is further needed is a capacity to mate a display advertising surface with a door handle type that does not permit a bracket to surround its axis for the full three hundred sixty degrees. What is further needed is electronic apparatus that supplies visual, audible and/or olfactory stimuli to make the display advertising surfaces more effective.

It is also known that consumers have long installed stainless steel appliances in their homes. One aspect of such appliances is that the fronts do not attract magnets, at least to the extent that previous metallic appliances did. Where consumers used to be able to attach notes, grocery lists or other papers to fronts of their appliances such as refrigerators, they are generally no longer able to do so with stainless steel versions. What is needed is the ability to add a marking surface to the front of an appliance.

SUMMARY OF THE INVENTION

The present invention eliminates the drawbacks of preexisting assemblies. In the embodiments described below, the invention includes bracket clips designed and shaped for preexisting legacy cooler door handles. In three of the embodiments below, the bracket clips are for handles that allow a full three hundred sixty degree wrap-around. In a fourth embodiment, the bracket clip is for handles that do not permit such a wrap-around, for example a full-length L-bar. Electronically-generated stimuli can be added, such as lights, sounds or smells. Other features and advantages of the present invention will become apparent from the detailed description below.

In another aspect, the present invention supplies a marking surface to the front of an appliance, such as a consumer's refrigerator door. Many of the ideas used for attaching display advertising assemblies to commercial cooler doors can be used to attach a marking surface to a consumer's refrigerator door. The marking surface should be illuminated in night lighting. Other features and advantages of this additional embodiment of the present invention will become apparent from the detailed description below.

DETAILED DESCRIPTION

The present invention is described below in its various embodiments and configurations. The description is not intended to be limiting, and instead the appended claims alone describe the metes and bounds of the rights under the present invention.

A. Ad Handles

Figure 1:
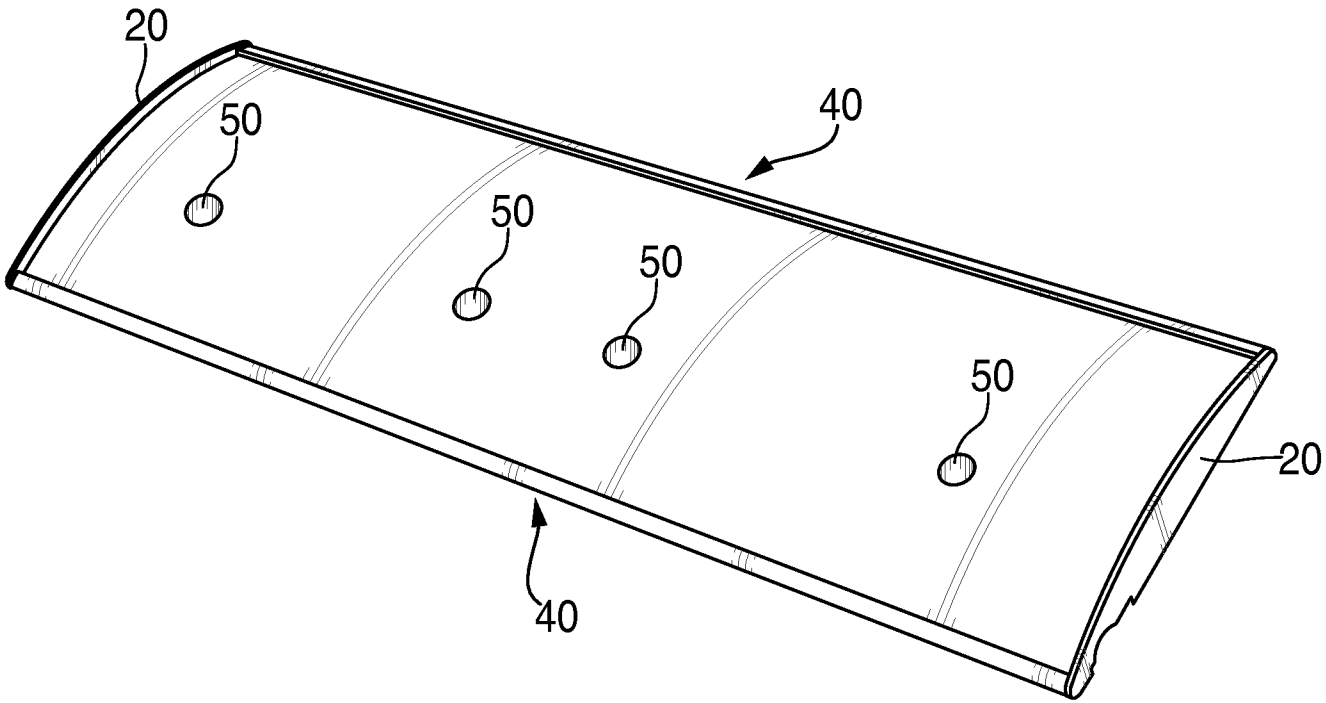
FIG. 1 is an elevation view of the front of a fully assembled display assembly, minus any display insert.

FIG. 1 shows an elevation view of the front of a fully assembled display assembly 10, minus any display insert. There is a top end cap 20 and a bottom end cap 30 inserted into the respective top and bottom of the display assembly. The display assembly 10 is generally rectangular, and in this embodiment has a convexly curved surface. Along each side of the curved surface is a lip flange 40. When one of the end caps is removed (e.g., the top), a display ad and its optional clear flexible cover (e.g., of thin transparent plexiglass) may be inserted into the display assembly. The end cap is then replaced. The display ad is thereby held in by the lip flange 40 and the respective end caps 20, 30. FIG. 1 also shows apertures 50 for receiving fastening screws 55 for the various kinds of brackets, to be described below.

Figure 2:
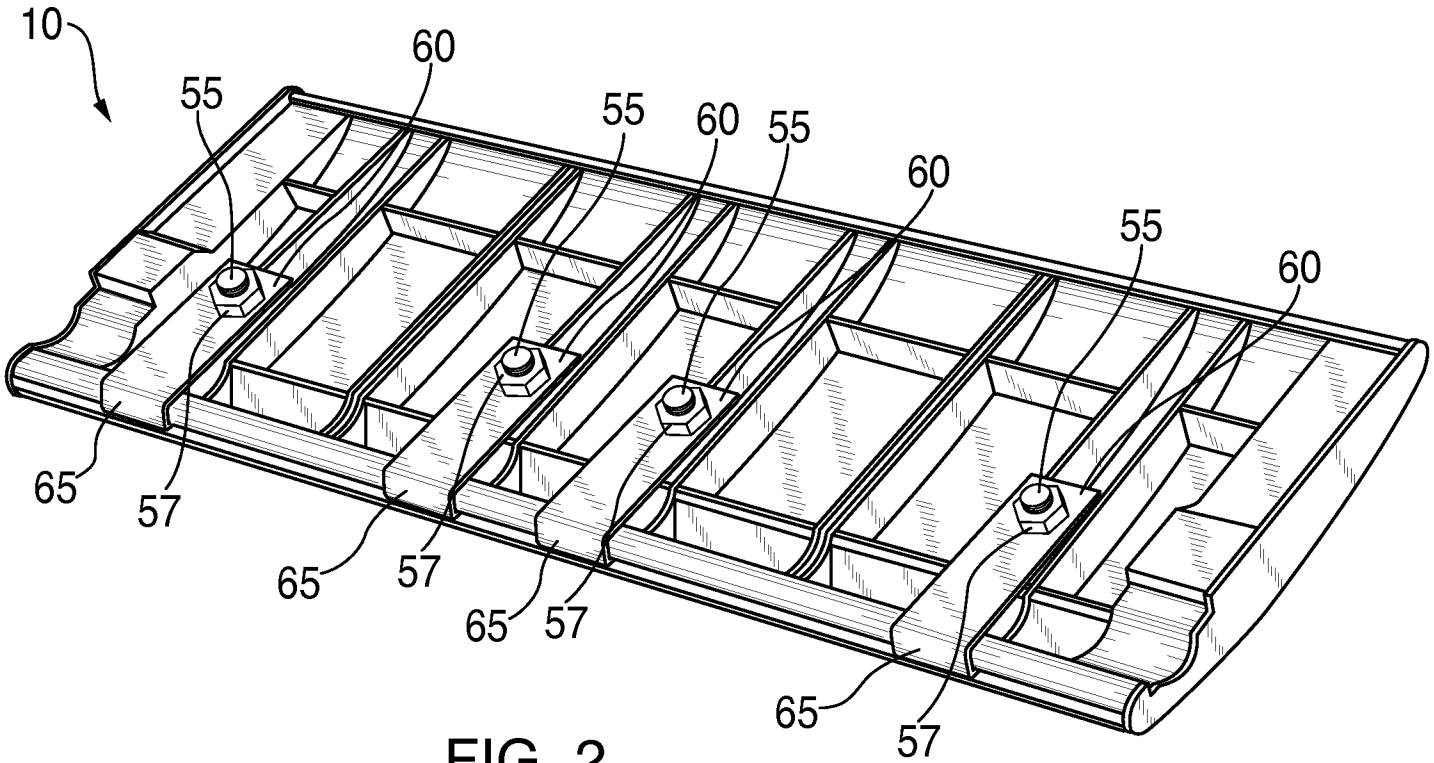
FIG. 2 is an elevation view of the rear of a fully assembled display assembly using a first bracket type to surround a first type of legacy handle.
Figure 9:
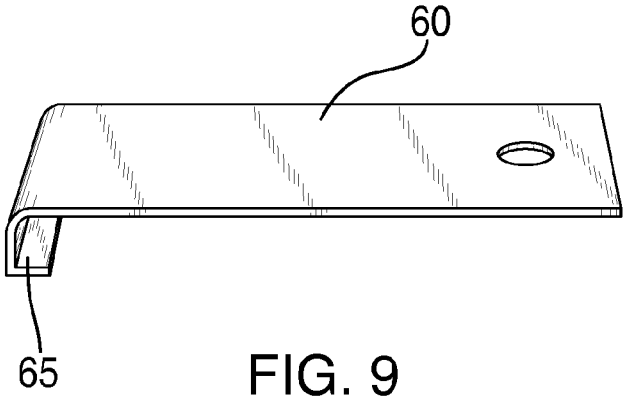
FIG. 9 is a perspective view of the individual brackets for the embodiment of FIGS. 2 and 5.

FIG. 2 is an elevation view of the rear of a fully assembled display assembly 10 using a first bracket type to surround a first type of legacy handle (namely, certain cooler handles by manufacturers Anthony and Ardco). The specific brackets 60 for this embodiment are more fully disclosed in FIG. 9, and are seen to be generally flat, with a J-shaped slot-fitting end 65. Opposite the slot-fitting end 65 is an aperture for receiving the above-mentioned fastening screw 55.

Figure 3:
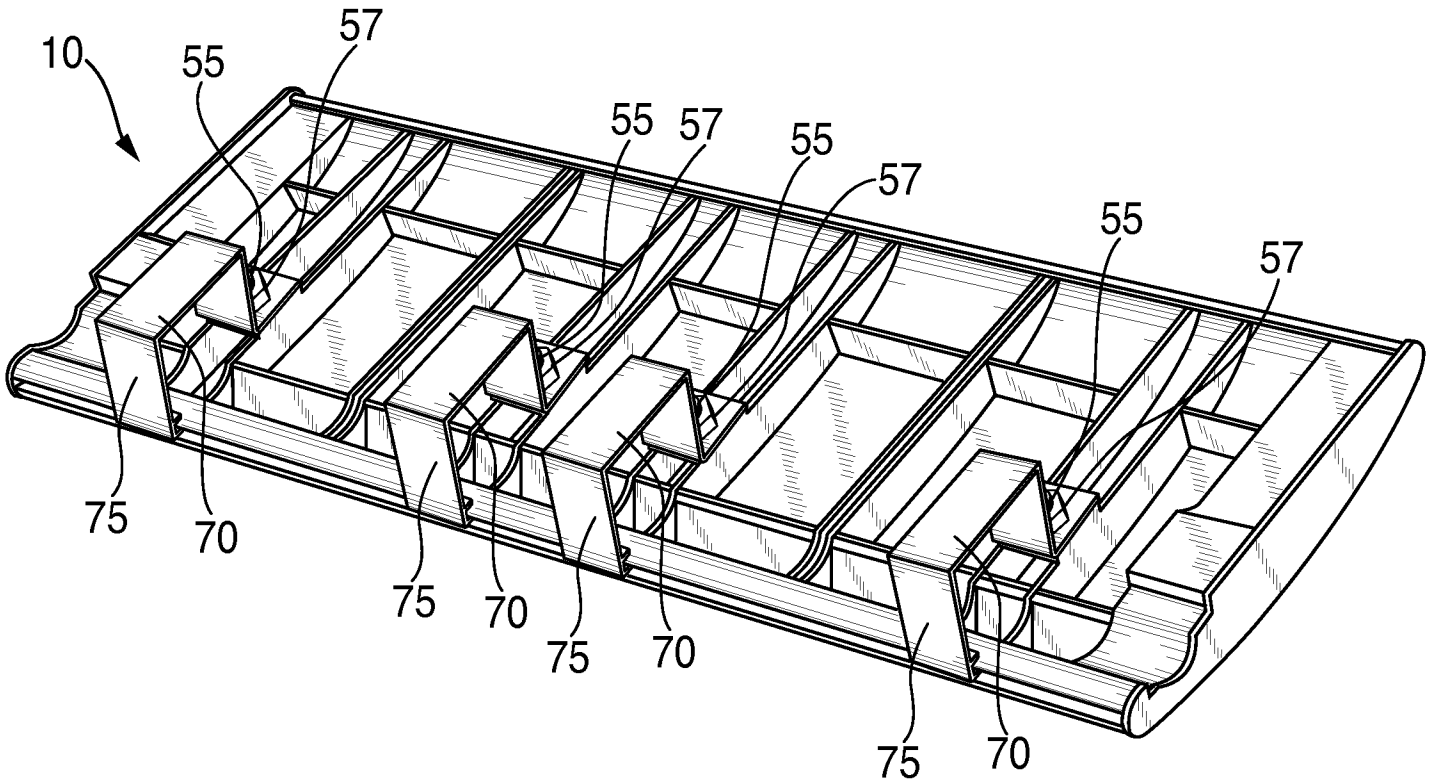
FIG. 3 is an elevation view of the rear of a fully assembled display assembly using a second bracket type to surround a second type of legacy handle.
Figure 10:
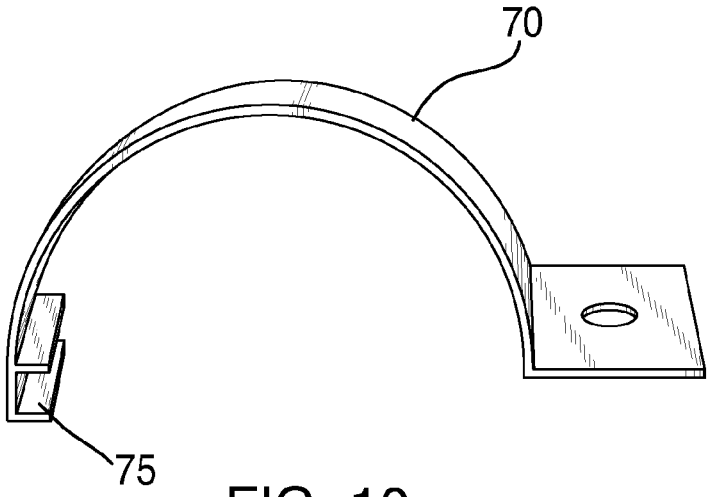
FIG. 10 is a perspective view of the individual brackets for the embodiment of FIGS. 3 and 6.

FIG. 3 is an elevation view of the rear of a fully assembled display assembly 10 using a second bracket type to surround a second type of legacy handle (namely, certain cooler handles by manufacturer Anthony, particularly more recent models). The specific brackets 70 for this embodiment are more fully disclosed in FIG. 10, and are seen to form a generally rectangular open shape, with a slot-fitting end 75. Again, opposite the slot-fitting end 75 is an aperture for receiving the above-mentioned fastening screw 55.

Figure 4:
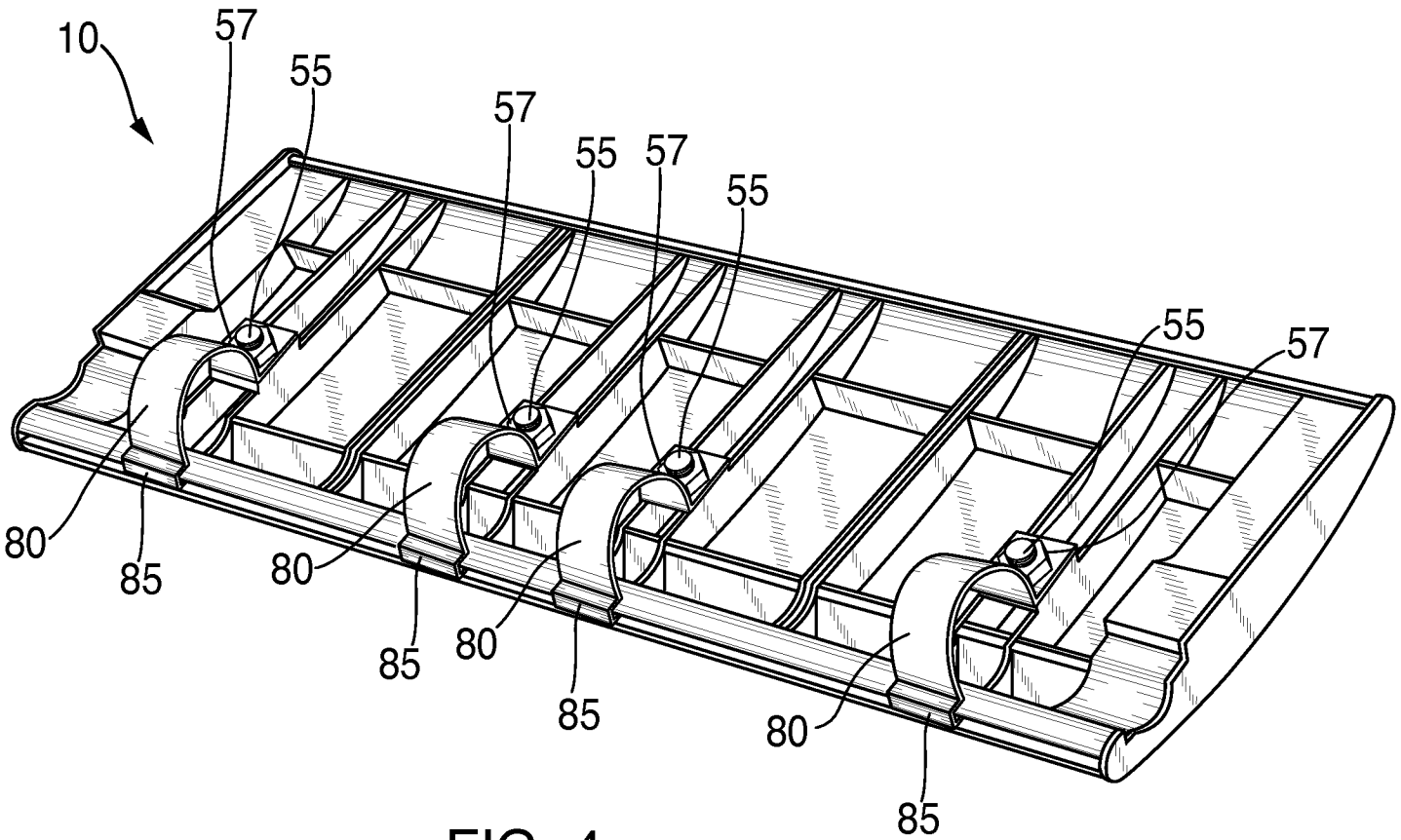
FIG. 4 is an elevation view of the rear of a fully assembled display assembly using a third bracket type to surround a third type of legacy handle.
Figure 11:
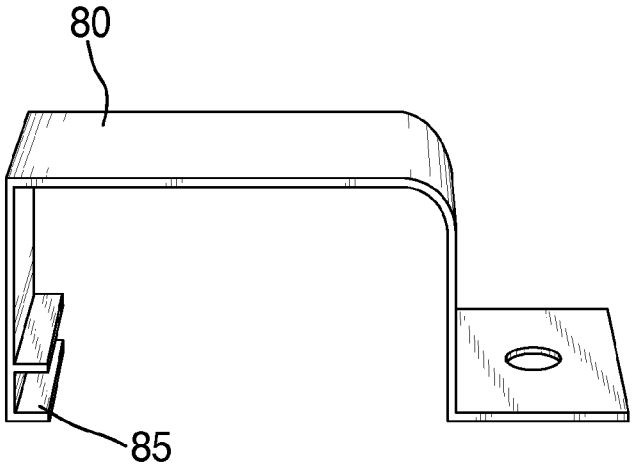
FIG. 11 is a perspective view of the individual brackets for the embodiment of FIGS. 4 and 7.

FIG. 4 is an elevation view of the rear of a fully assembled display assembly 10 using a third bracket type to surround a third type of legacy handle (namely, certain cooler handles by manufacturer Hussman). The specific brackets 80 for this embodiment are more fully disclosed in FIG. 11, and are seen to form a generally rounded, open C-shape, with a slot-fitting end 85. Again, opposite the slot-fitting end 85 is an aperture for receiving the above-mentioned fastening screw 55.

Figure 5:
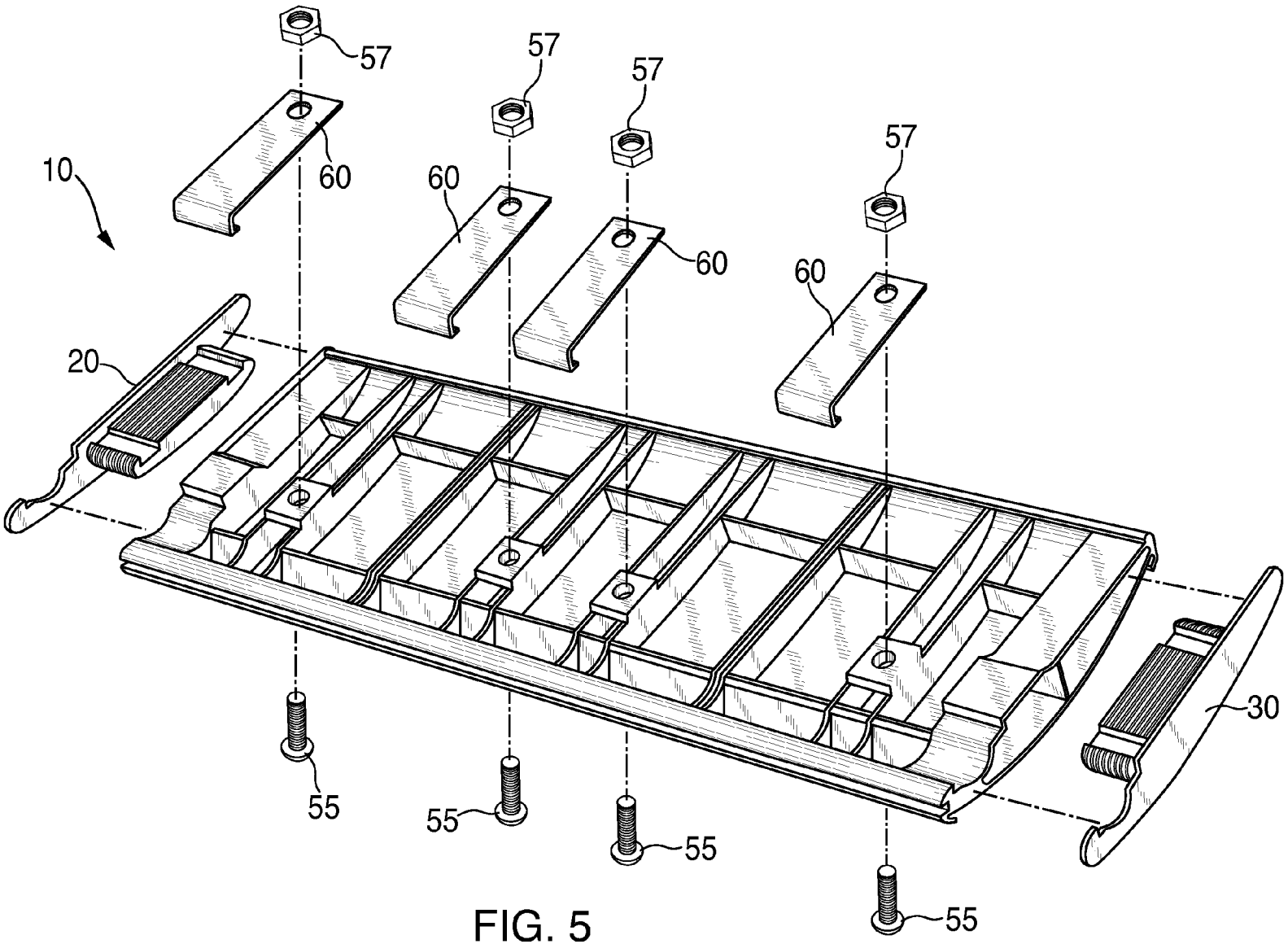
FIG. 5 is an exploded rear view of the assembly of FIG. 2.
Figure 6:
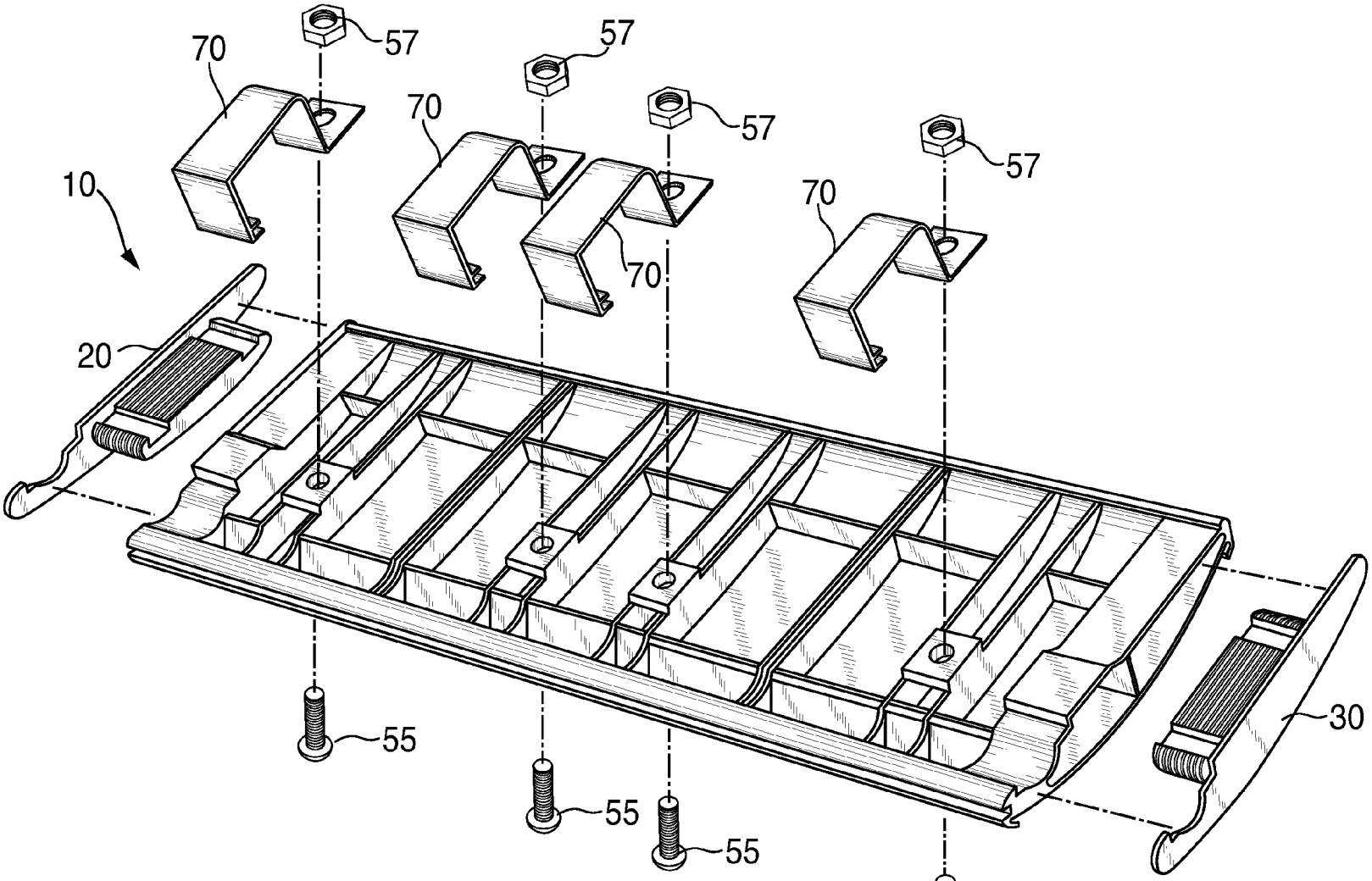
FIG. 6 is an exploded rear view of the assembly of FIG. 3.
Figure 7:
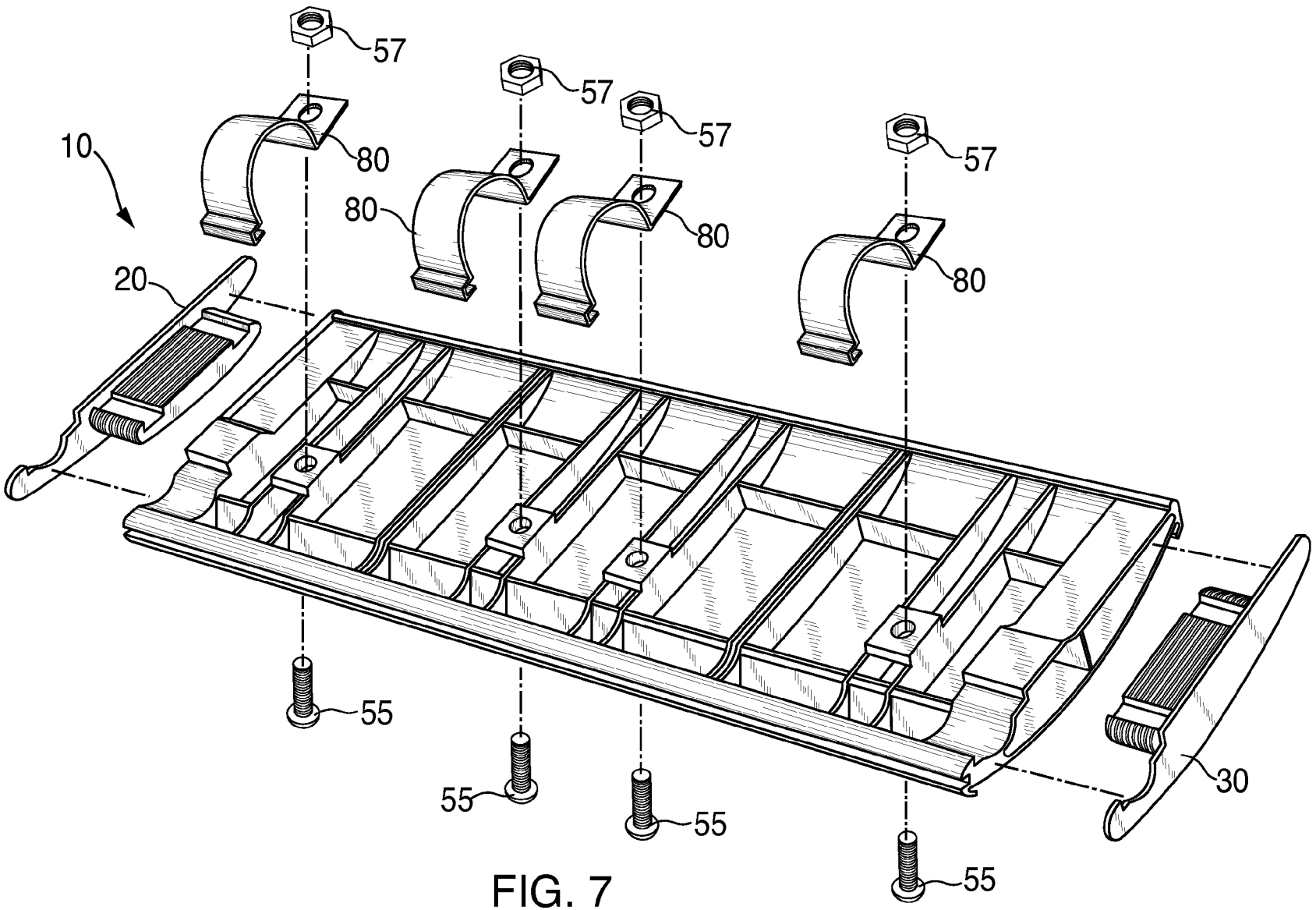
FIG. 7 is an exploded rear view of the assembly of FIG. 4.

FIGS. 5, 6 and 7 show perspective views depicting how the brackets 60, 70, 80 are attached to the display assemblies 10 of the present embodiments. The apertures on the front of the display assembly are larger than the ones on the back, such that a fastening screw 55 will pass completely through the front into the inner volume, so that its head rests flush against the back aperture. Then the respective bracket 60, 70, 80 is placed over the screw body, and the fastening nut 57 installed. In this way, a retailer or advertiser may easily install the display assembly 10 around the legacy door handle using conventional tools (such as a screwdriver and a wrench or needle pliers). Once installed, a consumer would pull on the display assembly 10 to open a cooler door, usually while looking right at it and its inserted-ad.

Figure 8:
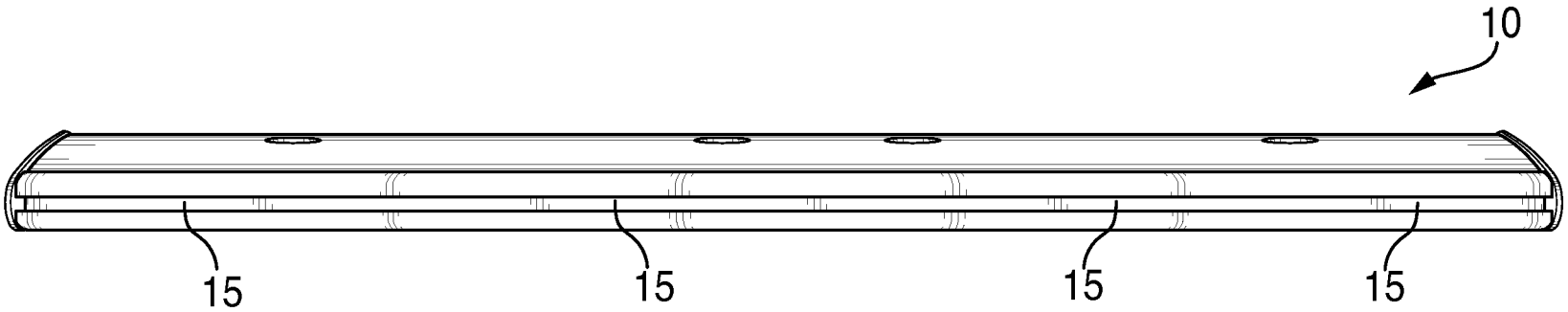
FIG. 8 is a side view of the assembly of the present invention.

FIG. 8 shows a side view of the display assembly 10, indicating where the slots 15 are for receiving the slot-fitting end 65, 75, 85 of the various brackets. It will be apparent that to affix the brackets 60, 70, 80, the slot-fitting end 65, 75, 85 is inserted into its slot, and then the screw 55 and bolt 57 are connected from the front to complete the connection. For the embodiments described so far, the final assembly will completely surround the legacy door handle.

Figure 12:
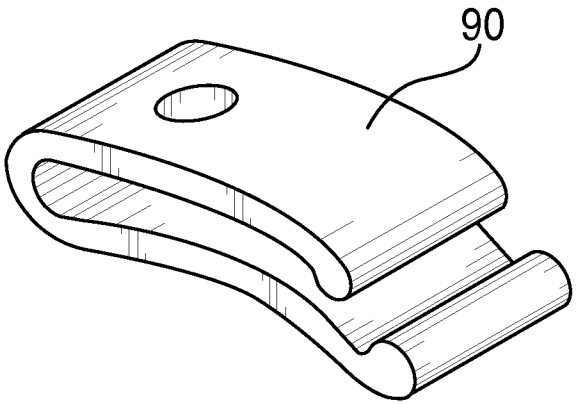
FIG. 12 is an elevation view of a different type of compatible bracket, for use as a clamp where a cooler door cannot be completely surrounded.

FIG. 12 is an elevation view of a different type of compatible bracket 90, for use as a clamp where a cooler door handle cannot be completely surrounded. It is assembled in the same way as the above-mentioned brackets, but results in an open tension-clamp, having bulbous ends. The embodiment of FIG. 12 is particularly useful for cooler door handle types like the full-length handles that may exist on the Anthony Model 101 cooler. Such handles are an L-shaped member running from top to bottom of the door, and thus do not allow brackets to completely surround them.

Figure 13:
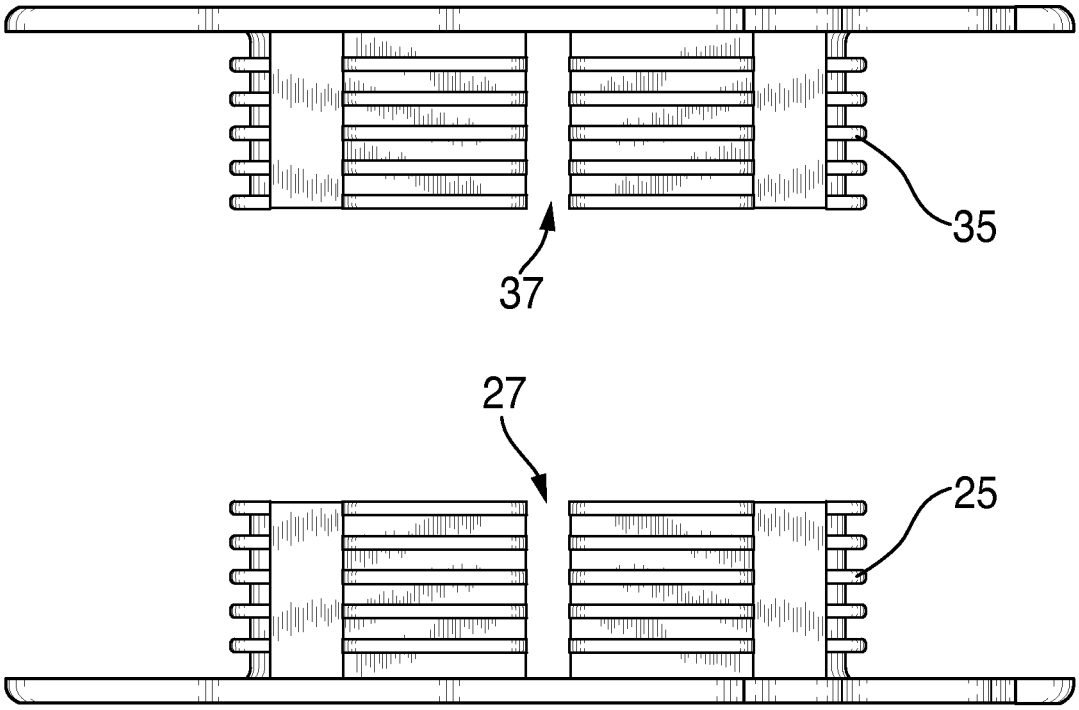
FIG. 13 is a side view of each end cap of the assembly of the present invention.
Figure 14:
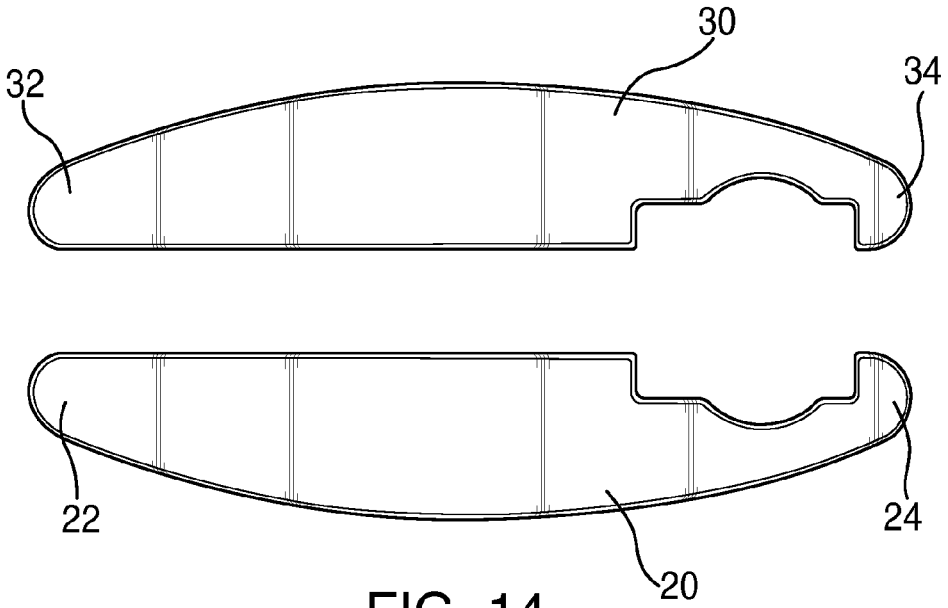
FIG. 14 is a top view of each end cap of the assembly of the present invention.

FIGS. 13 and 14 show, respectively, side and top views of the respective end caps (top 20 and bottom 30). These end caps 20, 30 are shaped asymmetrically to generally match the curved, asymmetrical cross section of the display assembly volume. They are inserted using a friction-fit. They each have two ends—distal 22, 32 from the bracket side, and proximal 24, 34 to the bracket side. Each end has projecting fin planes 25, 35 sized to allow a friction fit into the display assembly. Between the fin planes is an opening 27, 37 to allow passage into the volume of the display assembly, without interfering with a structural bar within such volume. The end caps may optionally be expanded in length, and fitted with electronics to provide battery-powered lighting displays, and/or sounds. Such lighting and sounds may be activated by proximity sensors, or by any other known means. In this way, the end caps may contribute even greater attention-attraction to the display assembly of the present invention.

Figure 15:
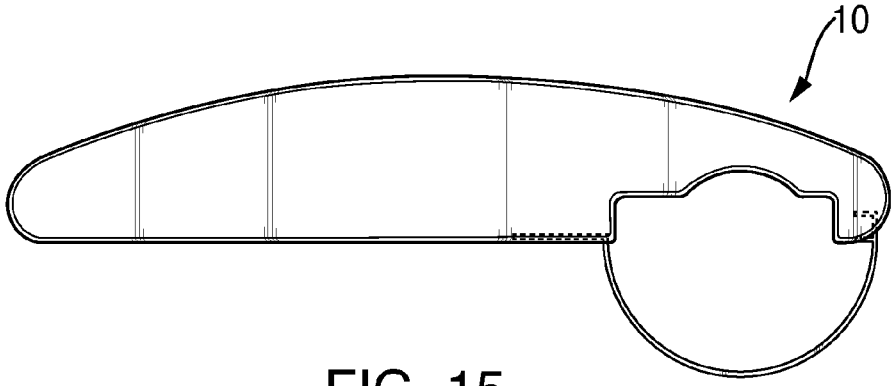
FIG. 15 is a top view of the assembly.
Figure 16:
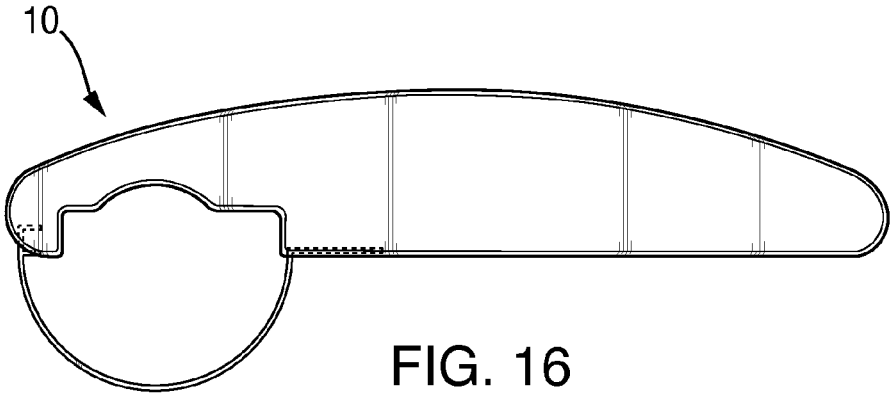
FIG. 16 is a bottom view of the assembly.

FIGS. 15 and 16 show, respectively, top and bottom views of the fully assembled display assembly 10. The asymmetry of the cross section, and its curvature from the proximal to the distal ends, are clearly indicated.

Figure 17:
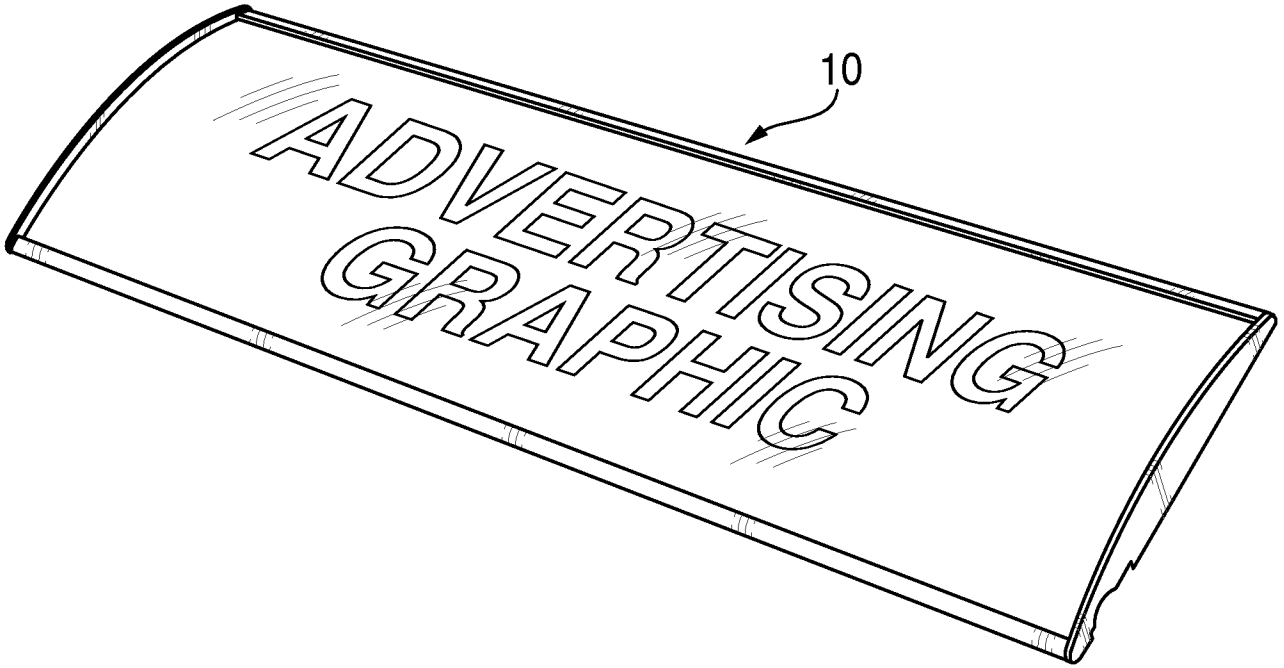
FIG. 17 is the assembly of FIG. 1, showing an exemplary display ad fully inserted.

FIG. 17 shows an elevation view of the front of the fully assembled display assembly 10 of the present invention, now equipped with an actual display ad. The display ad may be removed and replaced as desired by removing one of the end caps, and sliding the graphic material in and out over the front curved surface and under the lip flange. It will be appreciated that insertion of a display advertisement blocks any view of the screw apertures and screw head.

The display assembly 10 may be made of any suitable stiff material. Examples include aluminum or plastic. If made from plastic, ribbing across the rear may advantageously provide additional stiffness (as shown in the rear views of the figures described above). If made from aluminum, such ribbing is advantageously left off.

The display assembly 10 may also be supplied with an adhesive (not shown) applied to the curved part of assembly 10 that would cooperate with the brackets to enclose a preexisting door handle. That location could be, for example, the part of assembly 10 along the bottom of FIGS. 2-7 just interior to the edge. An installer would then perform the following steps to install the assembly 10: (1) remove any paper covering the adhesive, (2) stick the assembly onto the preexisting handle in the desired orientation (where such sticking helps stabilize the piece during the attachment process), (3) insert screws 55 into the front of at least two of the apertures 50, (4) place the appropriate brackets into the rear of the assembly 10 and its proper slots 15 to pass the bracket apertures over the screw body, and (5) tighten nuts 57 across the open screw body as necessary to complete the assembly. The brackets themselves may also optionally have paper-covered adhesive (not shown) which, when the paper is removed, will the pieces during the assembly process. When a display add is thereafter inserted, the screw heads will be covered from view.

B. Electronic End Cap

FIGS. 18-22 depict an improvement to the end caps 20, 30. In the improvement, the end cap body is expanded and fitted with battery-powered electronics. These electronics permit a fully installed display assembly 10 to emit visual, audible, and/or olfactory stimuli. This has the advantage of making any display advertisement more likely to be seen, and thus more likely effective.

Figure 19:
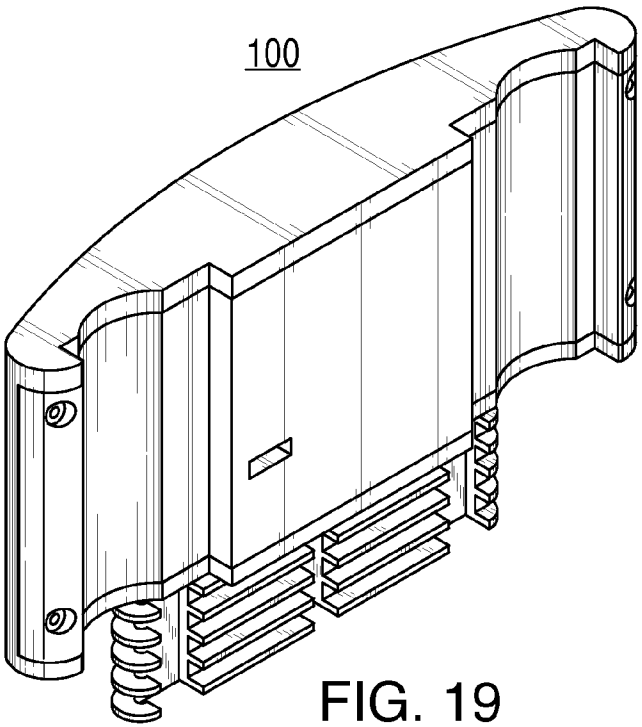
FIG. 19 is a view of the rear surface of the electronic end cap of the present invention.
Figure 18:
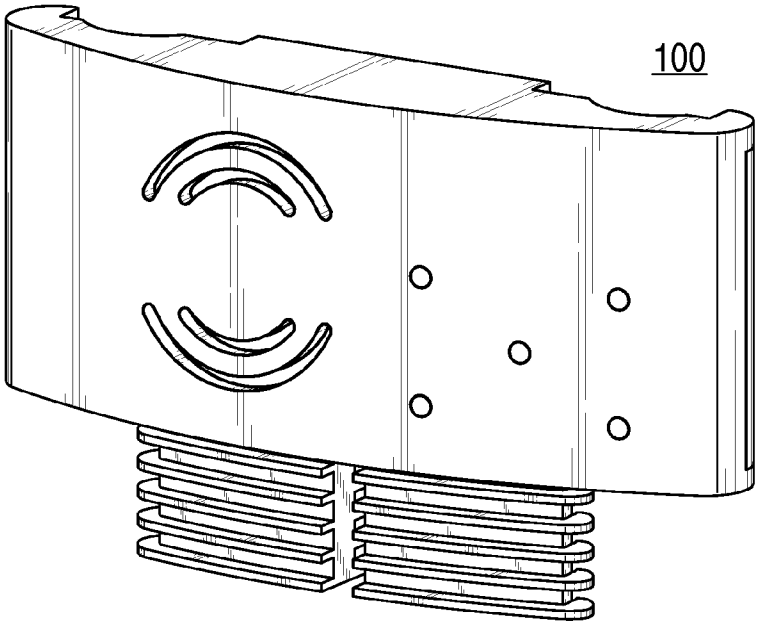
FIG. 18 is a view of the front surface of the electronic end cap of the present invention.

FIG. 18 shows the front of electronic end cap 100. Its general cross section is comparable to that of end caps 20, 30, including the fin planes that permit a friction fit into assembly 10. However, it is expanded in height so that its volume permits the addition of electronics. FIG. 19 shows the rear of electronic end cap 110. The rear contains a battery door for easy replacement of DC batteries.

Figure 20:
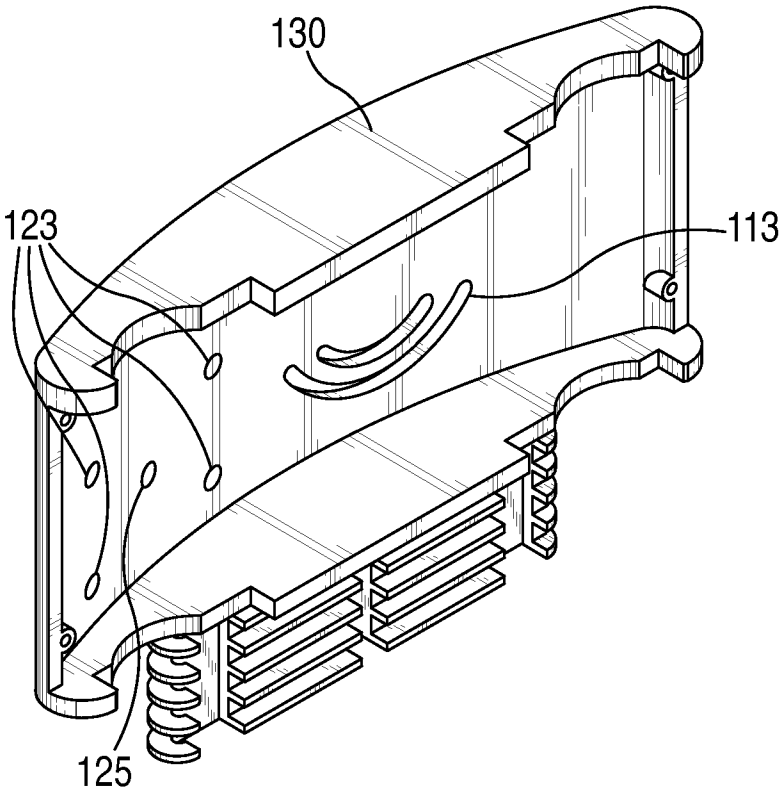
FIG. 20 is a view of the inside surface of the front of the electronic end cap of the present invention.
Figure 21:
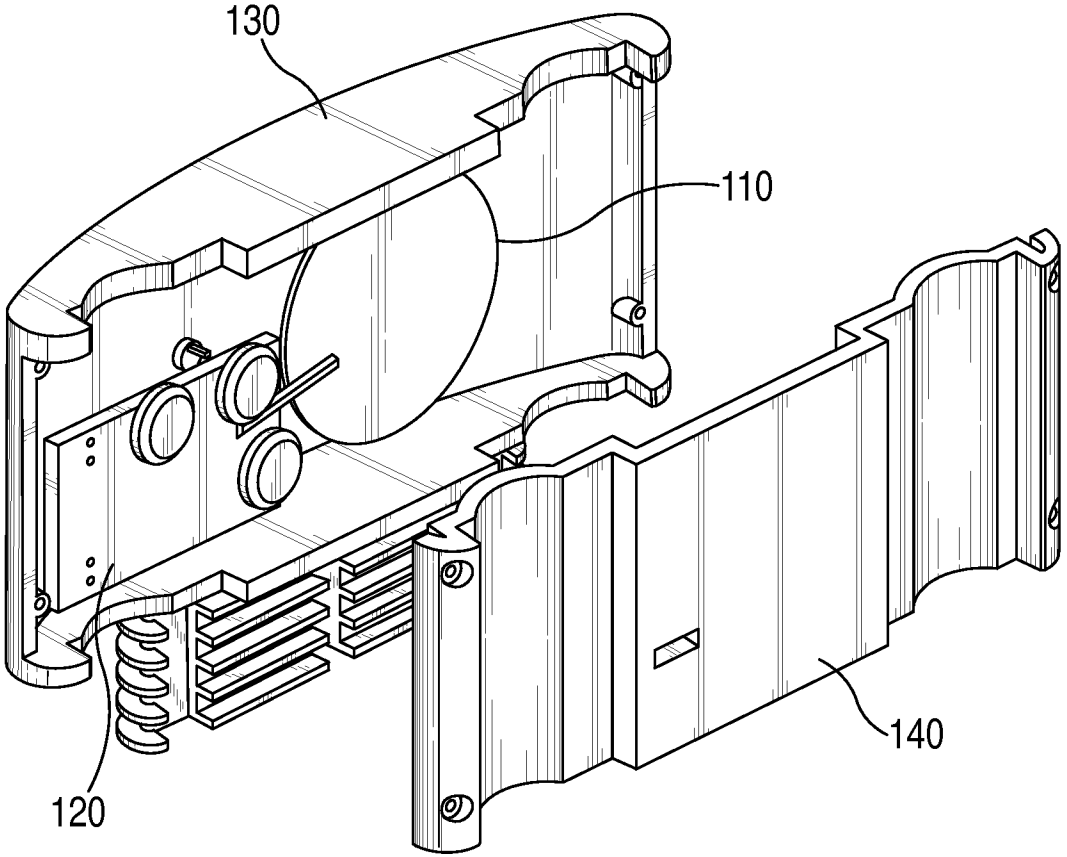
FIG. 21 is a view of the inside of the front of the electronic end cap of the present invention, as equipped with a circuit board and speaker.

The front 130 and back 140 of the housing for electronic end cap 100 are preferably separate pieces that are attached together. FIG. 20 shows the interior surface of front 130. Front 130 has four apertures 123 for the passage of light from LEDs, and one aperture 125 for the receipt of light by a photodiode acting as a motion detector (alternatively, an infrared detector may be used). Front 130 also has an opening 113 to pass the sound from a speaker. FIG. 21 shows front 130 installed with some of the aforementioned features, along with an exploded view of back 140. Notably, FIG. 21 shows speaker 110 and circuit board 120 installed in their proper spaces.

Figure 22:
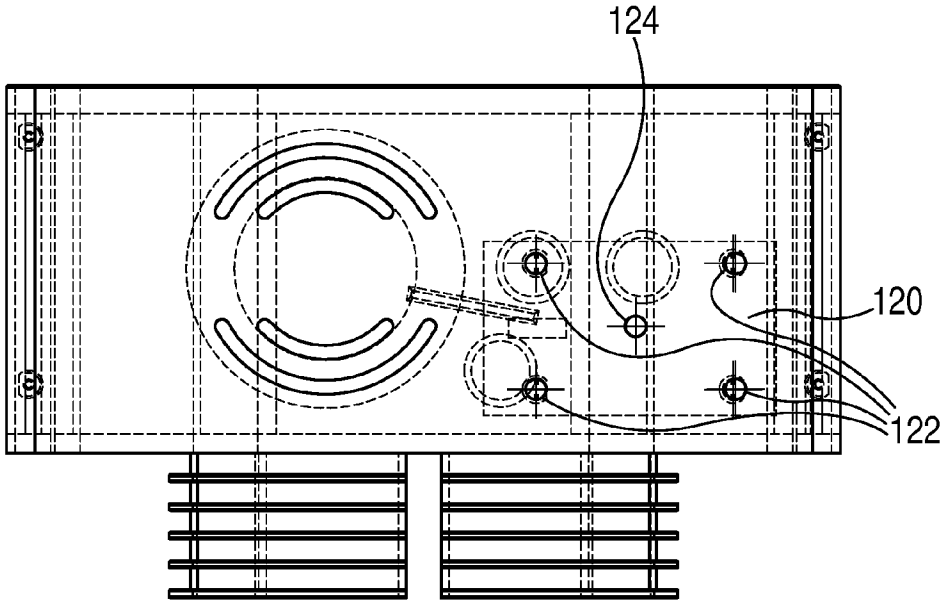
FIG. 22 is a see-through view of the interior of the electronic end cap of the present invention, as seen from the front.

FIG. 22 is a see-through view looking through front 130, as if the housing were transparent. It shows electronic end cap 100 fully equipped with speaker 110 and circuit board 120. Circuit board 120 contains red LEDs 122 for outputting light through the aforementioned apertures 123, and photodiode 124 for receiving light through the aforementioned aperture 125. Not shown here are wires from the battery contacts, or wires from a power switch. A power switch (not shown) is preferably situated on the top of electronic end cap 100, for example within a depression of a 2 mm diameter hole. Such a switch may be a spring biased pushbutton that is reached through the use of a small rod (not shown) or unwound paper clip (not shown).

Circuit board 120 operates under control of a controller chip (not shown) that governs its functionality, to be described here. The controller chip is made by Bollar International (HK) Ltd., of Hong Kong, China. Once batteries are loaded (e.g., three AAA type batteries) and the electronic end cap 100 is fully assembled, it may be used in place of (for example) top end cap 20. It will fit into the top of display assembly 10 as the top end cap. An optional lock screw (not shown) can be used to prevent theft. The small rod or unwound paper clip (not shown) can be used to push the power switch once. This switches on the electronic end cap 100. Advantageously, upon first activation, the four LEDs 122 will flash briefly to indicate power-up. At that point, all control is based on detection by photodiode 124. When light across the diode changes to create a sufficient change in electrical potential, the controller chip would "interpret" that change as motion crossing in front of display assembly 10. This can be assumed to be a person passing by. The sensitivity can be made so that the range of detection is 1 meter. The controller chip will then create whatever sensory stimuli are desired to attract the attention of the passerby. And such stimuli might run through a sequence after successive detections. For example, circuit board 120 can come preinstalled with audio data memory, such as for a .WAV file (though for all purposes here, a different audio file format may also be used, e.g., MP3). The audio can be music, speech, foley, sounds of nature, white noise, or any combination of the above as desired in the particular advertising context. Alternatively, circuit board 120, may contain a socket (not shown) for engagement of a memory card (e.g., a micro SD card) that contains the .WAV file. In this alternative embodiment, there would also be a slot in either front 130 or back 140 to cooperate with the socket for engagement of such a card. This would permit replaceability of the audio program.

In a further audio alternative, either front 130 or back 140 may contain a USB port socket. Circuit board 120 couples to this socket under control of the controller chip. The USB functionality governed by the controller chip works in either of two ways. First, when a user inserts a portable USB drive (e.g., a thumb drive) containing a single .WAV file, that .WAV file will automatically be identified as a sound file and will be downloaded onto circuit board 120 to replace the previous sound file. Second, when a user inserts a USB cable connected to a computing device, the computing device will allow deletion and replacement of the .WAV file (e.g., by appearing within a drive/ folder on the computer's desktop that can be modified via the computer's operating system). The file being downloaded (in either case) should contain less than two minutes of audio, preferably less than one minute.

Whichever the case may be (either pre-installed audio, replaceable audio, downloadable audio), one advantageous sequence might be as follows:

A. LED flash—30 seconds on when detector is tripped.

B. Time out—30 seconds in which the stimuli will not activate.

C. Sound—30 seconds on when detector is tripped.

D. Time out—30 seconds in which the stimuli will not activate.

E. LED flash and sound—30 seconds when detector is tripped.

F. Time out—30 seconds in which the stimuli will not activate.

G. Sequence begins again.

To save battery life, a user of electronic end cap 100 would turn off the device with the same power switch used to turn the device on.

Figure 27:
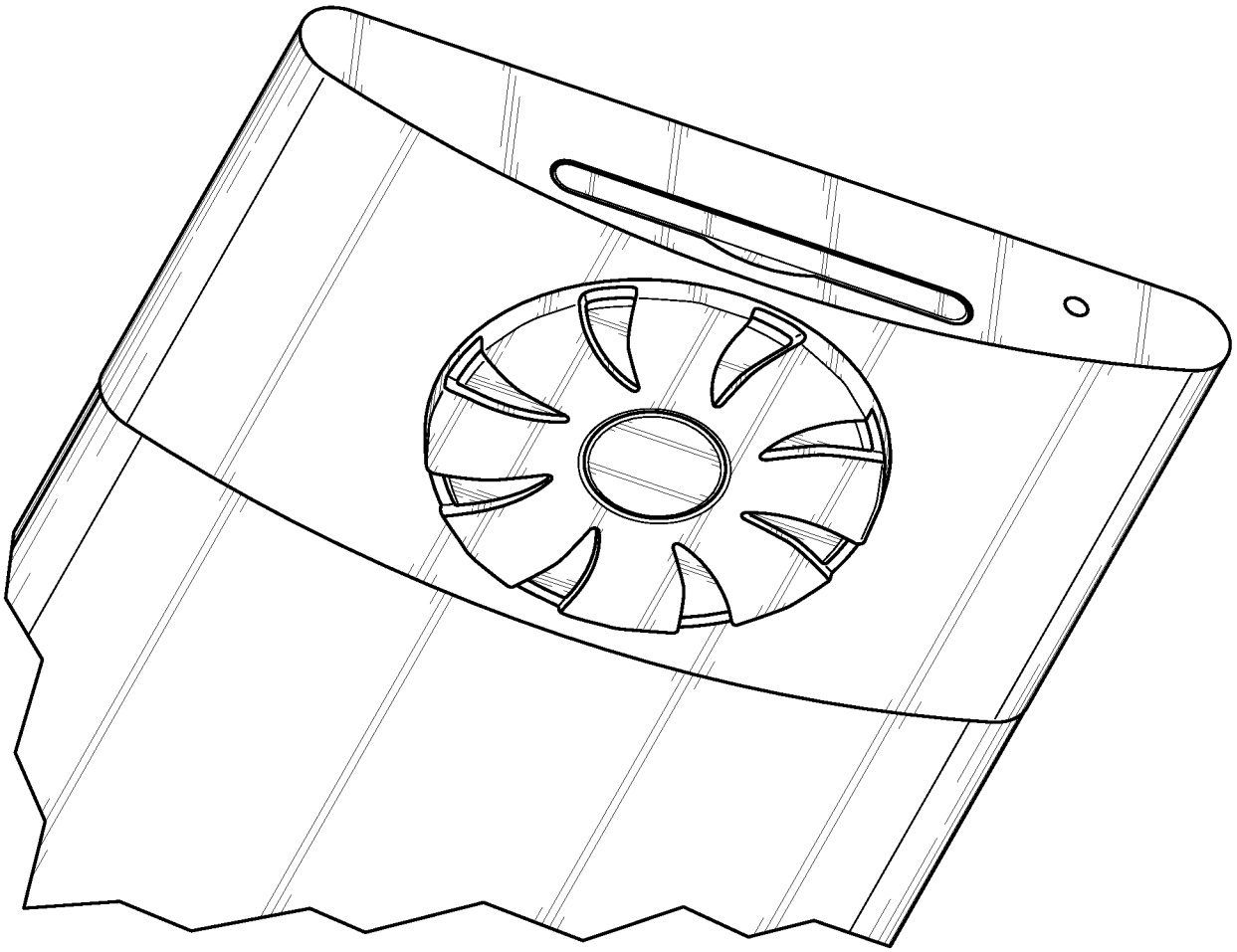
FIG. 27 is a front view of the electronic end cap of the present invention that generates olfactory stimuli.

While the aforementioned functionality describes light and sound, smell may also be used. In an optional embodiment shown in FIGS. 26 and 27, a small fan may be placed within electronic end cap 100. Just as there can be a slot in the housing for an optional .WAV card, there can also be a slot in the housing for an optional removable and replaceable smell-card. Such a slot would ensure that the smell card rests in front of the fan. The smell card would be impregnated with aromas appropriate for the desired advertising context. The housing for electronic end cap 100 would have venting to permit the operation of the fan to blow the aroma of the smell card outwardly away from display assembly 10. There can also be fan louvers or other structural means (e.g., an iris, a shutter, etc.) to minimize the amount of aroma that comes out when the fan is off. The three AAA batteries mentioned above would power the fan. However, to increase the amount of power available for the operation of the fan, and thus increase battery life, an aroma-equipped electronic end cap 100 may be powered by four to eight AA batteries built into the display assembly 10, such as those enclosed in a snap-connected wire harness in the rear (not shown).

In operation, controller would be programmed to activate the fan (and any desired louver/iris/shutter-engaging relays or motors) to emit aromas as part of an actuation sequence of the electronic end cap 100. From the foregoing, one of skill in the art would appreciate that virtually any desired combination of light flashes, sounds and smells, in virtually any desired sequence, can be actuated by a person or persons walking in front of display assembly 10 outfitted with electronic end cap 100.

C. Edge Lighting of Display Ad Surface

A different embodiment of the display assembly 10 would also use a motion detector as described above. In this case, the motion detector would serve to trigger the lighting of the display surface itself. One side of the lip flange 40 would be equipped with LEDs, pointed across the display ad surface (e.g., ten on one long side of the lip flange). To maintain attractiveness, the LEDs would shine through apertures in the lip flange 40. Those LEDs would be electrically connected to a controller, such as that described above with respect to the electronic end cap 100. Battery power can come from a side panel in the housing of display assembly 10, giving easy access for making battery changeouts. In addition, the convex front surface of display assembly 10 would contain a flexible matt, mesh or grid of LED lights. Those lights when activated would light up the transparent or translucent parts of a display ad creative.

In operation, the lighting discussed below attracts attention to an otherwise stagnant piece of paper advertising. The lighting can be sequenced using a motion detector, much as the electronic end cap 100 does. The lighting design can be programmed and customized in conjunction a specific display ad design. That is, desired parts of a display ad may be lit from behind in any time sequence that might be desired. For instance, a colorful display ad might have white translucent areas denoting a two word brand name. A designer might program the controller to activate selected ones of the mesh of LEDs to lighten the first word of the brand for 1 second, turn that word off and then lighten the second word of the brand for 1 second. In one example, there can be eight different lighting sequences. Within each lighting sequence, there can be up to seven changes in the lights' on-off state—56 possible light combinations total. The flexible LED matt and its controller are made by EL Lighting and Top Right Opto-Electronics of Zhuhai and Hong Kong, China.

D. Note Board Assembly for Refrigerator Doors

Many of the teachings of the foregoing embodiments have been incorporated into the note board assembly 200 of the present invention. The note board assembly 200 is primarily (though not necessarily exclusively) a consumer based item enabling the keeping of notes on today's modern refrigerators. The current trends are for laminates and stainless steel, which do not allow for kitchen magnets to be used for notes and lists. Note board assembly 200 is constructed as a plastic injected unit, and attaches to virtually any refrigerator handle through the use of the bracket and/or clip system described above with regard to display assembly 10.

Figure 23:
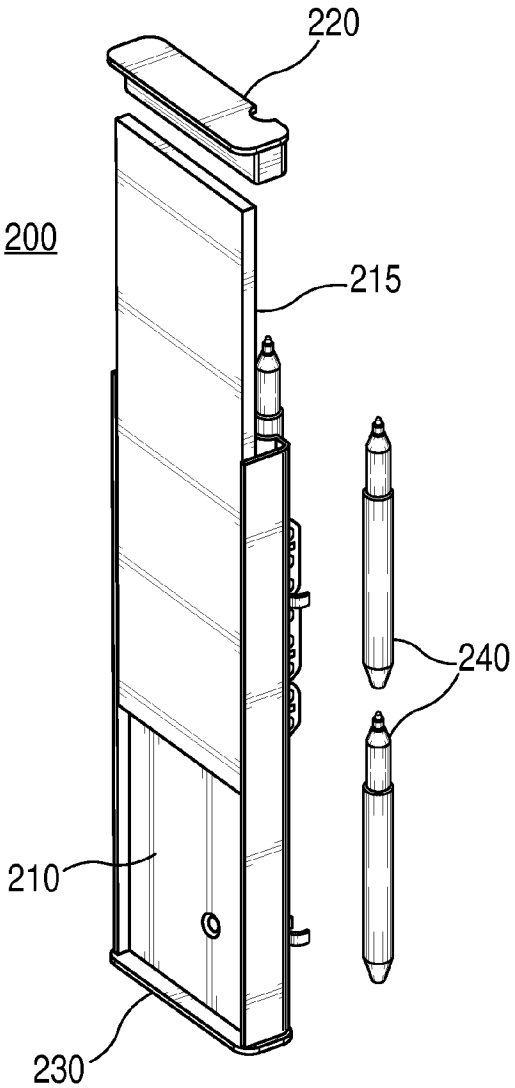
FIG. 23 is an exploded view of the note board assembly of the present invention.

FIG. 23 shows an exploded view of note board assembly 200. Unlike display assembly 10, note board assembly 200 has a flat outer surface for its housing 210. Like display assembly 10, there are end caps 220 and 230. Unlike display assembly 10, the slide-in material is board surface 215, rather than a plexiglass-fronted display ad. Pens 240 would be affixable in the back of housing 210, and are contemplated to be wet-erase fluorescent marker pens, for example, model 14075 from Sanford Expo.

Two contemplated embodiments for board surface 215 are (A.) a black wet erase board such as that made by Sanford Expo, and (B.) an LED sidelit board of hard clear acrylic with black backing (with side-lighting in accordance with the teachings described above for a different embodiment) such as that made by Flashing Boards. The LED lighting for embodiment B is battery powered. With the use of the fluorescent marking pens, the LED side lighting gives a brilliant and wet erasable message area. Side lighting is accomplished with motion detection (in accordance with the teachings described above for a different embodiment). Alternatively, side lighting can be accomplished with sound detection using a microphone apparatus (not shown). Motion-detected light activation works well in both daylight and dark, allowing the note board assembly 200 to be used as a night light for the kitchen area.

Figure 25:
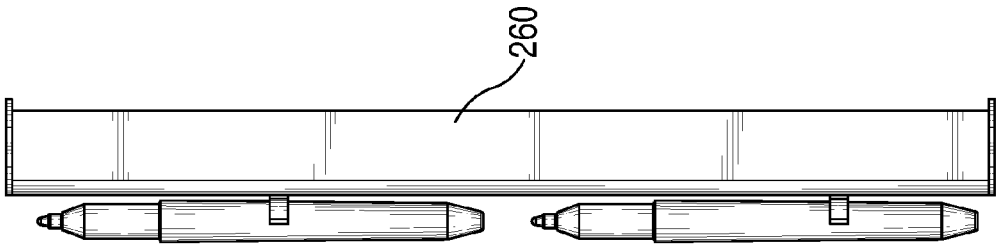
FIG. 25 is a side view of the note board assembly of the present invention.
Figure 24:
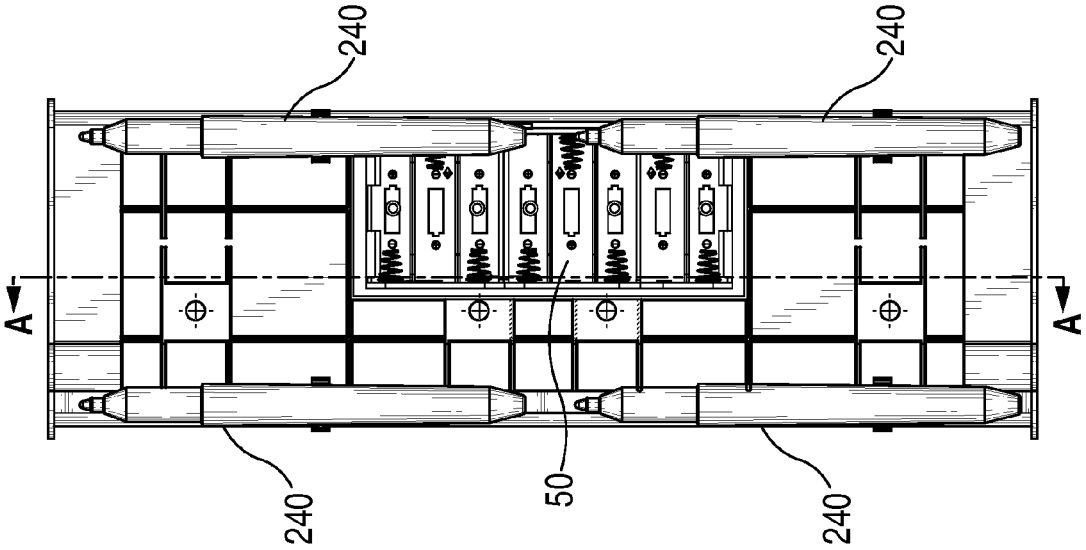
FIG. 24 is a rear view of the note board assembly of the present invention.
Figure 26C:
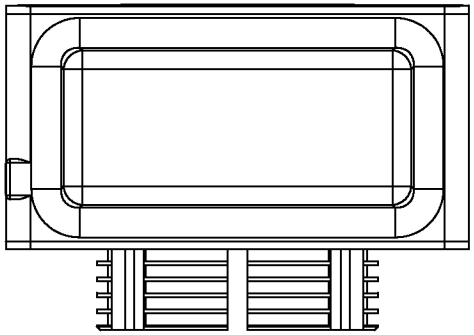
FIG. 26 is a schematic view of the electronic end cap of the present invention that generates olfactory stimuli.
Figure 26D:
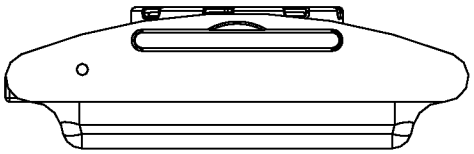
Figure 26A:
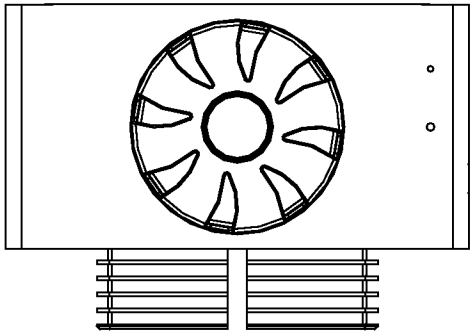
Figure 26B:
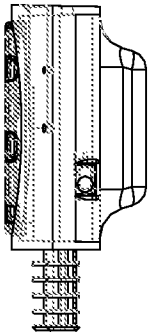

FIG. 24 shows a rear view, including battery compartment 250. The batteries are accessed through a side door structure 260, as indicated in FIG. 25. Side door access obviates any need to remove the note board assembly 200 during battery replacement.

While the invention has been described with particular reference to specific embodiments, it will be apparent to those skilled in the art that the same principles may be used in similar arrangements. The invention is not limited to the precise structures described. Various changes and modifications may be made without departing from the spirit and scope of the invention as defined by the claims below.

I claim:

1. A display system comprising:

a surface for holding a graphical display, a bracket or clamp physically coupled to the surface for affixing the surface to the handle of a door, and a motion or proximity sensing device, physically coupled to the surface, at least one lighting device electrically coupled to the motion or proximity sensing device, at least one aperture for the receipt of light by the motion or proximity sensing device, and at least one aperture for the passage of light from the lighting device, whereby a person passing in front of the surface causes the lighting device to actuate.

2. The system of claim 1 wherein the door is a cooler or refrigerator door.

3. A display system comprising:

a surface for holding a graphical display, a bracket or clamp physically coupled to the surface for affixing the surface to the handle of a door a motion or proximity sensing device, physically coupled to the surface, a plurality of lighting elements positioned on the surface to be sandwiched between the surface and any inserted graphical display, and electrically coupled to the motion or proximity sensing device, at least one aperture for the receipt of light by the motion or proximity sensing device, and at least one aperture for the passage of light from the plurality of lighting elements, whereby a person passing in front of the surface causes the plurality of lighting elements to actuate.

4. The system of claim 3 wherein the door is a cooler or refrigerator door.

5. The system of claim 3 further comprising electronics that sequentially actuate selected ones of the plurality of lighting elements.

* * * * *